United States Patent [19]

Nardone

[11] 4,347,970

[45] Sep. 7, 1982

[54] CONTAINER CLOSURE

[75] Inventor: Robert M. Nardone, Whippany, N.J.

[73] Assignee: Colgate-Palmolive Company, New York, N.Y.

[21] Appl. No.: 180,108

[22] Filed: Aug. 21, 1980

[51] Int. Cl.[3] ..... B65D 5/10

[52] U.S. Cl. ..... 229/39 R; 229/45 R

[58] Field of Search ..... 229/39 R, 38, 45 R

[56] References Cited

U.S. PATENT DOCUMENTS

| | | | |
|---|---|---|---|
| 2,400,443 | 5/1946 | Stopper | 229/39 R |
| 3,074,613 | 1/1963 | Cupo | 229/39 R |
| 3,580,477 | 5/1971 | Roth | 229/39 R |
| 3,871,571 | 3/1975 | Cupo | 229/39 R |
| 4,279,379 | 7/1981 | Lohrbach | 229/39 R |

FOREIGN PATENT DOCUMENTS

| | | | |
|---|---|---|---|
| 1179154 | 10/1964 | Fed. Rep. of Germany | 229/39 R |

*Primary Examiner*—Herbert F. Ross

*Attorney, Agent, or Firm*—Le Blanc, Nolan, Shur & Nies

[57] ABSTRACT

A carton has a plurality of side panels each connected by a fold line to one of a series of end closure flaps, there being a major flap having two oppositely located and oppositely angularly related slots canted with respect to the fold line of that flap with none of the slot edges are parallel to the fold line, and two minor flaps each having a correspondingly canted tab are adapted when the minor flaps are folded inwardly to slidably enter the slots in the major flap folded thereover and smoothly overlie the upper surface of the major flap in the slot area. Each major flap slot has upper and lower straight end edges with each inner slot end edge being straight and inclined at a small acute angle relative to a line parallel to the major flap fold line, and each minor tab has converging straight side edges with the tab edge nearer the flap fold line extending at a small acute angle relative to a line perpendicular to the fold line.

8 Claims, 6 Drawing Figures

CONTAINER CLOSURE

This invention relates to containers for detergent and like particulate materials and particularly to containers which are filled and closed in automatic machinery.

Containers of this type are usually rectangular boxes. The blank for a box is stamped out of relatively stiff sheet cardboard-like material in an operation that provides the side panel and end closure flap fold lines and cuts the closure flaps to size and shape. The blank is usually folded along the longitudinal panel fold lines with panel regions at opposite sides of the blank adhesively secured together and so supplied in collapsed flat condition to the detergent manufacturer.

The manufacturer places the collapsed box in machinery that erects the carton to tubular condition, closes the bottom closure flaps, fills the box with the required amount of detergent and then closes the top closure flaps in sequence.

One of the problems encountered by the manufacturer is leakage of the packaged material at the closure flap ends, and considerable effort has been expended over the years toward solving this problem. The problem is particularly acute in the packaging of detergents which are often small soft fragile hollow ball-like particles some of which on handling fracture and result in smaller particles and even powder-like particles which may sift through spaces between interlocked end closure flaps.

There have been many proposals as to modes of associating and interacting end closure flaps for solving the problem, and among the more successful has been the structure disclosed in U.S. Pat. No. 3,074,613 issued to Cupo and cartons made in general conformity with the Cupo teachings and exemplified in the PRIOR ART showing at FIG. 1 of the drawings herein, and collectively known hereinafter as Cupo-type carton closures.

In the prior art Cupo-type cartons, the tabs of folded in end closure flaps were inserted from below through slots in an unprinted folded in side flap to extend slightly over the upper surface of the unprinted flap and then the other side flap is folded over and adhesively bonded to the three underlying interlocked flaps.

It is the major object of the invention to improve upon the end closure flap construction of the Cupo-type prior art, particularly in the mode of interlock between end closure flaps and the unprinted side flap.

It is a further object of the invention to provide a novel container structure wherein foldable front and rear major end closure flaps and foldable end closure flaps are provided, with one of the major flaps having oppositely located and angularly extending slots of special structure and disposition adapted for novel cooperation with tabs on minor end flaps.

Another object of the invention is to provide in a carton a novel interlock arrangement between a foldable major side closure flap and two foldable minor end closure flaps wherein the major flap has two spaced slots each adjacent a side edge that diverge in angular relation toward the fold line for that major flap, with the edge of each slot nearest the fold line being a substantially straight edge extending at a small acute angle relative to a line parallel to that fold line, and the minor end closure flaps each comprise a tab insertable from below through one of said slots with the edge of the tab that is to be disposed nearest the fold line of the major tab being straight and extending at substantially the same small acute angle relative to a line perpendicular to its fold line.

Another object of the invention is to provide a novel end closure flap structure for a container wherein a foldable major flap has adjacent each side a slot extending angularly relatively to the fold line, with the edge of each said slot nearest the fold line being straight and extending at a small acute angle relative to a line parallel to said fold line, and there being foldable minor end flaps having tabs adapted to enter said slots from below and each inserted tab having a side edge adapted to be substantially parallel to said one edge of the associated slot.

A further object of the invention is to provide a novel carton according to any of the foregoing objects and incorporating novel relief slits in the slotted major flap. Pursuant to this object each relief slit may comprise an arcuate central section terminating in end sections that extend substantially in the same direction as the opposite end edges of the slots, with at least one end section of the slit extending parallel to the adjacent straight edge of the associated slot.

Another object of the invention is to provide a novel one-piece blank, stamped with fold lines, cut outs and minor flap edge contours for forming cartons in accord with the foregoing objects.

Further novel features and other objects of this invention will become apparent from the following detailed description, discussion and the appended claims taken in conjunction with the accompanying drawings.

PRIOR ART

Figure 1:
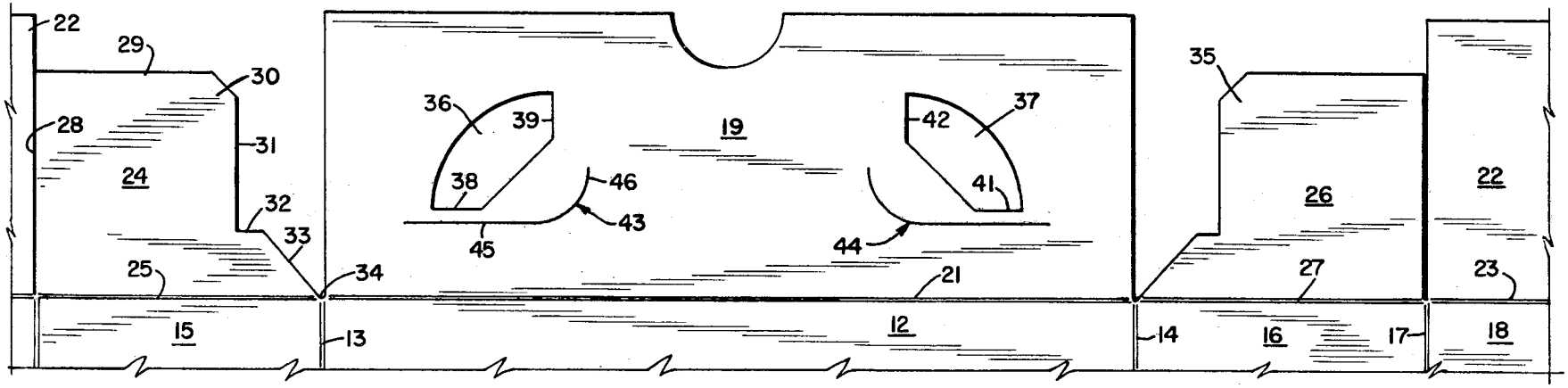
Fig. 1 PRIOR ART
FIG. 1 is an elevation showing a carton of known prior art as viewed from the inside of the carton and showing the relative locations and sizes of the end closure flaps on all of the longitudinal panels.

FIG. 1 shows the blank 11 of a known structure for a rectangular parallelopiped box adapted to be filled with detergent particles or like granular or powdery material.

Blank 11 comprises a rear box panel 12 joined by parallel fold lines 13 and 14 to similar end panels 15 and 16 respectively, and end panel 16 is joined by fold line 17 to a front panel 18 of the same perpheral dimension as panel 12.

A rear major end closure flap 19 coextensive with rear panel 12 is joined by fold line 21 to panel 12. A front major end closure flap 22 coextensive with front panel 18 is joined by fold line 23 to panel 18. One minor end closure flap 24 is joined by fold line 25 to panel 15, and the other minor end closure flap 26 is joined by fold line 27 to panel 16. The fold line edges of minor flaps 24 and 26 are coextensive with the associated end panels. The fold lines 21, 23, 25 and 27 are aligned end to end in the blank.

End flap 24 has a side edge 28 extending outwardly at right angles to fold line 25, an outer end edge 29 that extends parallel to fold line 25 and terminates short of major flap 19 to join an inwardly extending straight edge 31 perpendicular to fold line 25. Edge 31 extends to one end of a knee 32 parallel to fold line 25, and the other end of knee 32 is connected by an inclined edge 33 to the juncture 34 of fold lines 13, 21 and 25. The flap corner defined by edges 29 and 31 provides a tab 30 the purpose of which will appear.

End flap 26 is substantially a mirror image of flap 24 as shown, and similarly sized and shaped so that it includes a flap corner tab 35 similar to tab 30.

Major flap 19 is rectangular with parallel side edges perpendicular to the fold line 21, and it contains spaced generally arcuate slots 36 and 37 adjacent opposite ends. Slots 36 has one straight end edge 38 parallel to fold line 21 and slit section 45, and an opposite end straight edge 39 perpendicular to fold line 21.

Similarly slot 37 has one end edge 41 parallel to fold line 21; and its opposite end edge 42 is perpendicular to fold line 21. Slots 36 and 37 are of the same shape and size and are similarly located in flap 19 although at opposite ends and reversely curved.

In practice in this prior art structure blank 11 is folded into a rectangular tube structure on fold lines 13, 14 and 17, and panel 15 is adhesively secured upon a narrow folded edge extension of panel 18 similarly to that shown in U.S. Pat. to Cupo No. 3,074,613. The minor tabs are now bent toward each other about their fold lines, while major flap 19 is bent inwardly about is fold line, with corner tabs 30 and 35 slidably entering slots 36 and 37 from below to interlock the three flaps. Then adhesive is applied to the inner non-printed surface of printed flap 22 which is then bent inwardly over and against the interlocked flaps to form a flat end closure.

The foregoing arrangement of flaps and mode of assembly is substantially the same as disclosed in the foregoing Cupo patent.

The known prior art also includes J-shaped relief slits 43 and 44 formed in major flap 19 and not shown in Cupo patent.

Slit 43 comprises a straight section 45 just below and parallel to slot edge 38 and an upwardly curved section 46 disposed laterally inwardly of the slot 36. Slit 44 is similarly disposed relative to slot 37. Slits 43 and 44 are provided to allow flexure of the major flap 19 in the slot regions during assembly.

PREFERRED EMBODIMENTS

The invention will be described starting with FIG. 2 which is a layout showing the novel interlocking flap arrangement at one end disposed in a plane for ready comparison with the prior art of FIG. 1.

Figure 2:
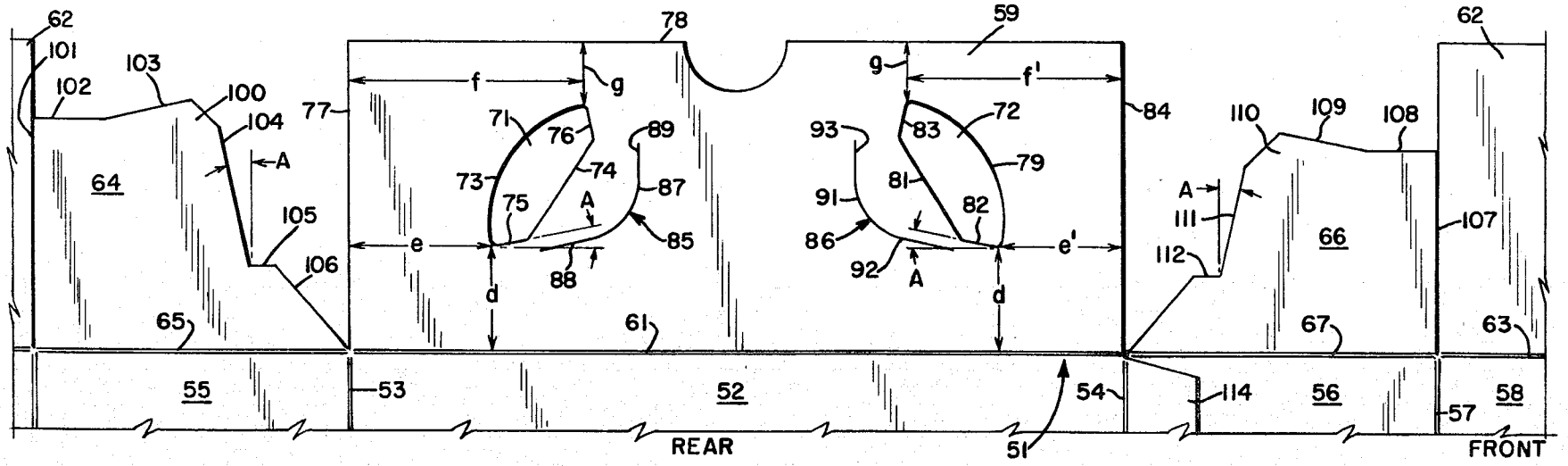
FIG. 2 is an elevation similar to FIG. 1, but showing a carton having end closure flap structure as they are related in the carton according to the invention and for purposes of comparison with FIG. 1.

FIG. 2 shows a carton 51 as a rectangular parallelopiped box adapted to be filled with detergent particles or like granular or powdery material.

The carton comprises a rear box panel 52 having parallel fold lines 53 and 54. Fold line 53 joins panel 52 with an end panel 55. Fold line 54 is at the corner defined by panel 52 and opposite end panel 56 in the erected carton. End panel 56 is joined by fold line 57 to front panel 58.

A rear major closure flap 59 coextensive with rear panel 52 is joined by fold line 61 to panel 52. A front major closure flap 62 coextensive with front panel 58 is joined by fold line 63 to panel 58. One minor end flap 64 is joined by fold line 65 to end panel 55, and the other minor end flap 66 is joined by fold line 67 to end panel 56. The fold line edges of end flaps 64 and 66 are coextensive with the associated end panels 55 and 56 respectively. The fold lines, 61, 63, 65 and 67 are aligned end to end in the blank.

To the foregoing extent the invention arranges the flaps similarly to said Cupo patent. The major distinctions as will appear lie in the slot, slit and interlocking minor tab structure and arrangement to be described.

Major flap 59 is an unprinted rectangular flap and it contains two cut out slots 71 and 72 that are generally arcuate and are oppositely angularly canted at the same angle relative to fold line 61.

Slot 71 has a curved outer side edge 73 opposite a straight inner side edge 74. Edge 74 extends at about 45° to fold line 21. The inner end edge 75 of slot 71 is straight and is inclined outwardly from the inner end of edge 73 to the inner end of edge 74 at small acute angle A relative to a line parallel to fold line 61. The outer end edge 76 of slot 71 is straight and may be inclined from the outer end of edge 73 to the outer end of edge 74 at a small acute angle relative to a line perpendicular to fold line 61. The included angle between edges 75 and 76 is preferably about 90°. Edges 75 and 76 are preferably of equal length, and edge 73 is preferably a circular arc.

In a form of the invention involving a so-called King size carton where flap 59 is 9" long and about 3½" wide, the intersection of edges 73 and 75 is located at a distance d about 1⅛" from the fold line 61 and a distance e about 1 11/16" from the side edge 77 of the flap. The intersection of edges 73 and 76 is located at a distance f about 2¾" from the adjacent side edge 77 of flap 59 and at a distance g of about 22/32" from the outer edge 78 of flap 56. Edges 72 and 73 are preferably of equal length.

Similarly slot 72 has a curved circular arc outer side edge 79 opposite a straight inner side edge 81 that extends at about 45° to fold line 61 but oppositely to slot edge 74. The inner end edge 82 of the slot is straight and inclined outwardly from the inner end of edge 79 at the small acute angle A relative to a line parallel to fold line 61. The outer end edge 83 of slot 72 is straight and may be inclined from the outer end of edge 81 at a small acute angle relative to a line perpendicular to fold line 61. The included angle between slot edges 82 and 83 may be about 90°. Edges 82 and 83 are preferably of equal length.

In this King size flap form of the invention the intersection of slot edges 79 and 82 is located at the distance d from the fold line 61 but at the distance e' of about 1 11/16" from the adjacent side edge 84 of flap 19. The intersection of edges 79 and 83 is located at the distance g from flap edge 78 but at the distance f' of about 2¾" from the flap edge 84.

Thus slots 71 and 72 which may be of the same size and outline are preferably located at the same distances from the fold line 61 but at different distances from the parallel side edges of flap 59.

In the preferred embodiment the angle A is about 12° in each case but may be slightly less.

Flap 59 has U-shaped relief slits 85 and 86 adjacent the respective slots. Slit 85 comprises an arcuate center section 87 terminating in opposite diverging straight sections 88 and 89 that extend generally toward the adjacent slot. Section 88 is substantially parallel to slot edge 75. Slit 86 comprises an arcuate center section 91 terminating in opposite diverging straight sections 92 and 93 that extend generally toward the adjacent slot. Slit section 92 is substantially parallel to slot edge 82. Thus the relief slits do not extend either inwardly or outwardly beyond the ends of their associated slots. Preferably a radius from the circular center section of each slit intersects the adjacent straight edge of the associated straight side (74, 81) of the adjacent slot at about right angles, so that the relief slits are substantially centered with the slots on oppositely inclined 45° axes.

End flap 64 has a straight side edge 101 perpendicular to fold line 61. The outer end edge of flap 64 comprises a straight section 102 that extends at right angles from the end of edge 101 and an outwardly inclined section 103 that extends at an acute angle with respect to a line parallel to fold line 61. The inner side edge of flap 64 comprises an inclined section 104 extending at right angles or slightly less from the end of section 103 and at angle A with respect to a line perpendicular to the fold line. At the end section 104 a straight knee section 105 extends parallel to the fold line 61, and an inclined section 106 extends from the end of knee 105 to the common intersection of fold lines 53, 61 and 65. In a workable embodiment the included angle between edges 103 and 104 is about 80°, and angle A is about 12° or slightly less.

The other end flap 66 has a free straight side edge 107 perpendicular to fold line 61. The outer end edge of flap 66 comprises a straight section 108 that extends at right angles from the end of edge 107 and an outwardly inclined section 109 that may extend from the end of section 108 an acute angle with respect to a line parallel to fold line 61. The inner side edge of flap 66 comprises an inclined edge section 111 that extends at right angles or slightly less from the end of section 109 and at the small acute angle A with respect to a line perpendicular to the fold line 67. At the end of section 111 a straight knee section 112 extends parallel to the fold line 61, and an inclined section 113 extends from the end of the knee 112 to the common intersection of fold lines 54, 61 and 67.

Thus the minor end flaps in the King size carton are generally similar in shape, except that as shown in FIG. 2 the outer edge 102, 103 of flap 64 is spaced further from fold line 65 than the outer edge 108, 109 of flap 66 is spaced from fold line 67. However the distance from side edge 107 to inclined side edge section 111 of flap 66 is preferably equal to the distance between side edge 101 and inclined side edge section 104 of flap 64. The corner tabs indicated at 100 and 110 respectively are thereby oppositely canted in the erected blank and located at different distances from the fold line 61.

In assembly of an erected carton the panels are folded on the longitudinal fold lines to form a rectangular tubular body with a minor side flap 114 on the outer edge of panel 52 folded inside and glued to end panel 56. Then the minor end panels 64 and 66 are folded toward each other while unprinted major panel 59 is folded over them with the corner tabs 100 and 110 sliding from below into slots 71 and 72 respectively, occupying the slot areas closely and projecting smoothly over the upper surface of panel 59.

The minor panel dimensions are such that flaps 100 and 110 are effectively centered with the slots in this operation, with edge 104 of flap 64 in effective sliding relation with slot edge 75, and with edge 111 of flap 66 in effective sliding relation with slot edge 82.

It has been found that the foregoing special tab and slot relationship eliminate a problem encountered in automatic machinery employed to effect inward bending of the flaps. This type of machinery as indicated in the said Cupo patent employs bars and ploughs which act on open-ended filled cartons moving on a conveyor belt to force the end closure flaps to bend about their fold lines. The problem encountered has been that, in the case of prior art cartons as shown in FIG. 1, as the major flap 19 is folded inwardly the bending forces exerted on the flap which primarily are designed to fold the flap about fold line 21 often result in the flap material bending and distorting in artificial score lines and in general alignment with the lower slot edges 38 and 41 and in the relief slit portions that are parallel to the fold line 21.

By providing the foregoing canted slots 71 and 72 and associated canted slits, any tendency of the flap material to bend or score in line with the slot edges and the slits is eliminated.

Moreover it has been found that surprisingly the coaction between the canted slots and the canted associated minor flap tabs results in a tighter more leak resistant interlock between flaps 59, 64 and 66 and enables a flatter interlocked assembly of those flaps.

As in the Cupo patent, closure is completed by folding the internally adhesive coated printed major flap over the three interlocked flaps, and since there is less distortion in the interlocked flap arrangement, a better smooth interface bonding is obtained and the entire closure benefits thereby.

Figure 3:
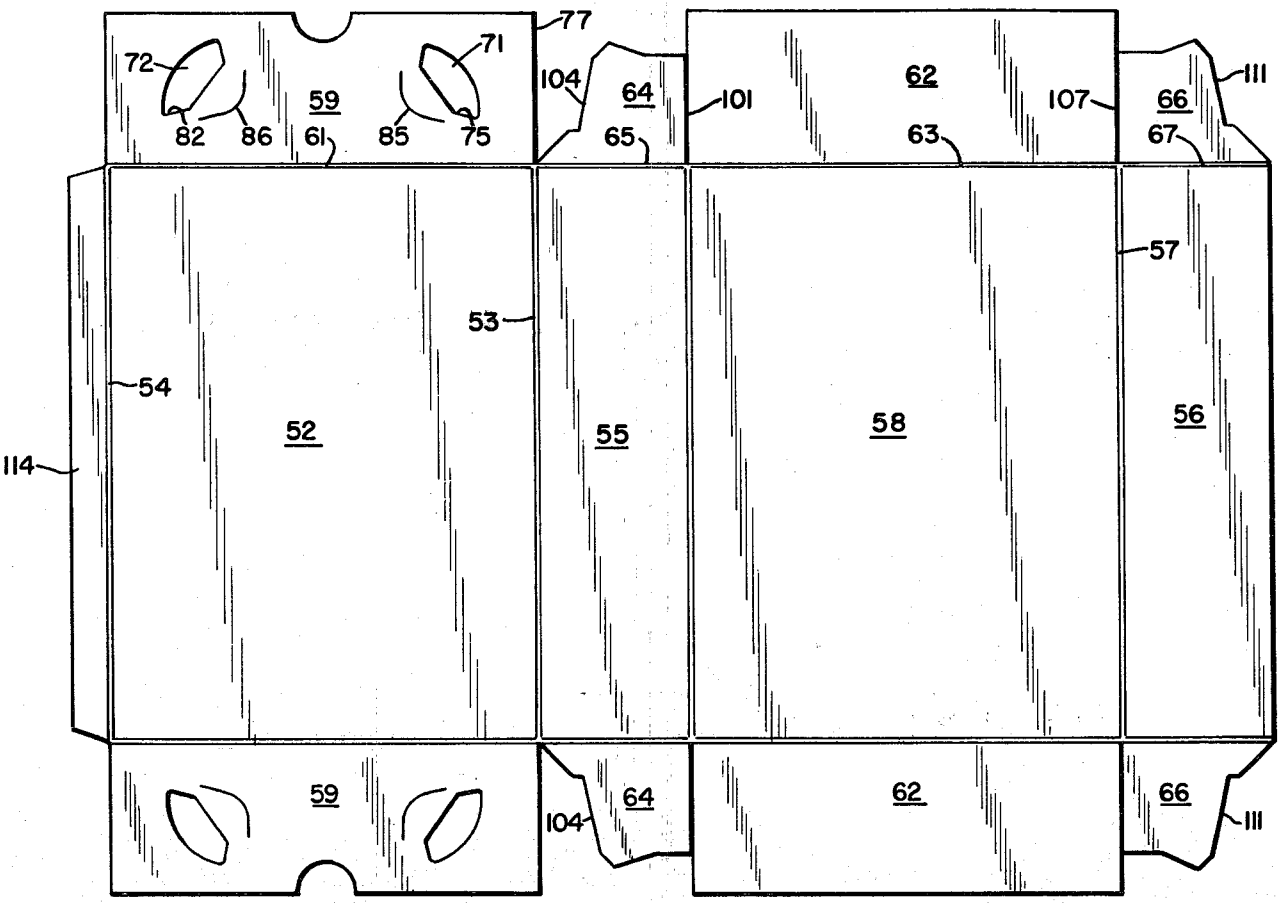
FIG. 3 shows a blank according to a preferred arrangement of the invention.

FIG. 3 illustrates a carton blank for the so-called Giant size carton which is slightly smaller than the King size. This also illustrates the relation of panels and flaps in the King size blank. The same numerals are used for corresponding parts. The only real difference between the King and Giant size cartons is that in the King size one major flap slot is located further from the side edge than the other, and the coacting end flap is longer, whereas in the Giant size the slots 71, 72 are located at the same distances from the major flap side edges and the end flaps are of the same size.

In both the King and Giant size cartons as shown in FIG. 3 the end flap structure is duplicated in both top and bottom.

Figure 4:
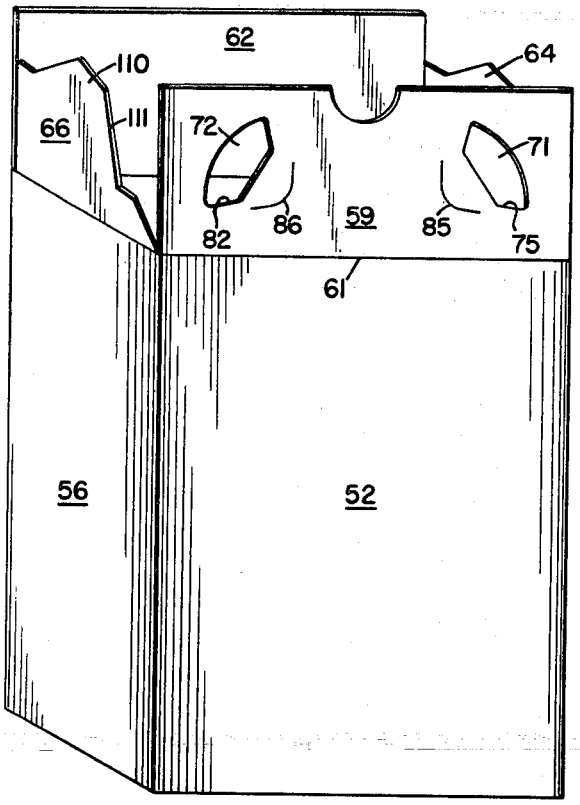
FIG. 4 is a generally perspective view illustrating the erected carton end flap arrangements.
Figure 5:
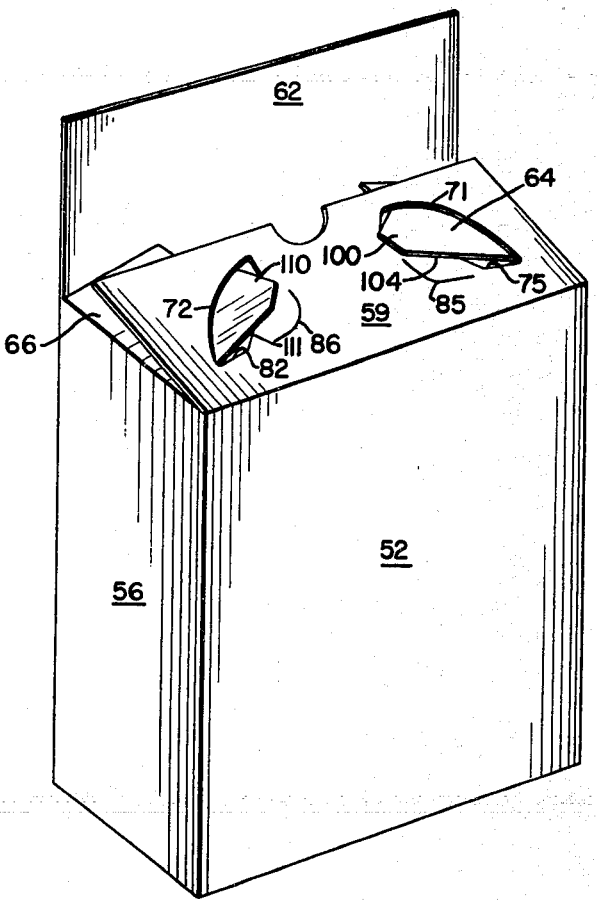
FIG. 5 is a further generally perspective view showing the order of folding of the end closure flaps and illustrating the minor end closure flaps partially inserted.
Figure 6:
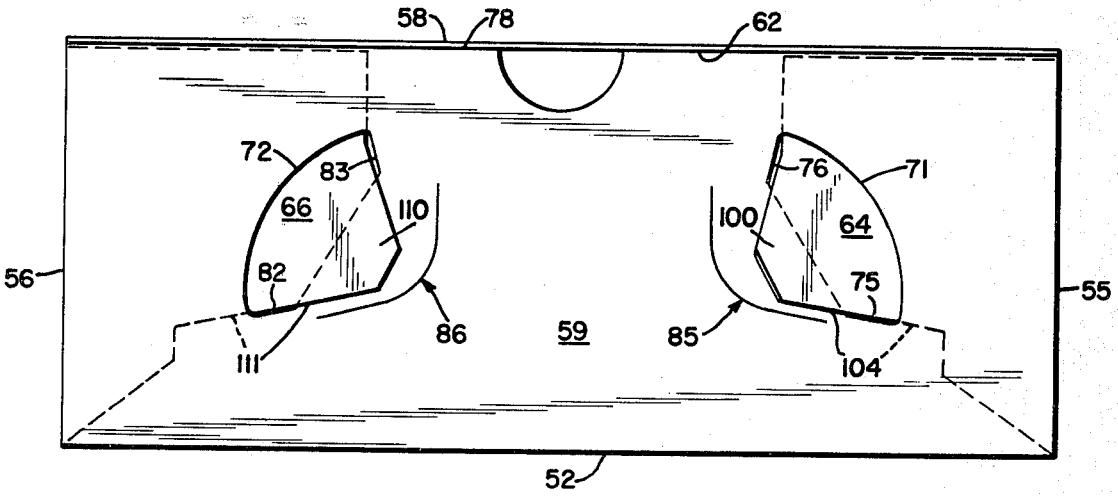
FIG. 6 is a plan view showing the carton structure of the invention at the point where the unprinted major end flap has been folded over and interlocked with the previously folded over minor end flaps, but before the printed major end flap is folded over to complete the closure.

Referring to FIG. 4, the erected carton is shown with the bottom flaps closed and the top end open. FIG. 5 shows the intermediate phase where the minor end flaps are projecting through the slotted imprinted major flap as the flaps are folded inward. FIG. 6 illustrates the final condition of interlock and it will be noted that tab edge 111 is closely engaged along slot edge 82 and tab edge 104 is closely engaged along slot edge 75.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. In a carton structure having a plurality of side panels each connected by a fold line to one of a series of end closure flaps, there being a major flap having two oppositely located and oppositely angularly related slots each having side edges and upper and lower end edges, said slots being canted with respect to the fold line of said major flap so that none of the slot edges are parallel to the fold line, each inner slot end edge being straight and inclined at a small acute angle relative to said fold line, and two minor flaps, each having a correspondingly canted tab adapted, when the minor flaps are folded inwardly, to slidably enter the slots in the major flap folded thereover and smoothly overlie the upper surface of the major flap in the slot area.

2. In the carton structure defined in claim 1, said major flap being rectangular with side edges extending at right angles to its fold line, said slots being located at different distances from said side edges and the minor flap whose tab enters the slot furthest away from its adjacent side edge being longer than the other minor flap.

3. In the carton structure defined in claim 1, said major flap being rectangular with side edges extending at right angles to the flap fold line, said slots being located substantially at the same distance from the said side edges and said minor flaps being of substantially the same size.

4. In the carton structure defined in claim 1, each tab in the minor flaps having converging straight side edges, with the tab edge nearer the fold line for each flap extending at a small acute angle relative to a line perpendicular to the fold line for that flap.

5. In the carton structure defined in claim 1, said small acute angles being substantially equal.

6. In the carton structure defined in claim 6, said acute angles being in the order of about 12°.

7. In the carton structure defined in claim 1, generally U-shaped relief slits in said major flap associated with each slot, each slit comprising an arcuate section with end sections diverging in the direction of the associated slot, and each slit being located no closer to the major flap fold line than its adjacent slot end edge.

8. In the carton structure defined in claim 7, the slit end section nearer the fold line in said major flap extending substantially parallel to the adjacent end edge of the corresponding slot.

* * * * *

UNITED STATES PATENT AND TRADEMARK OFFICE

CERTIFICATE OF CORRECTION

PATENT NO. : 4,347,970

DATED : September 7, 1982

INVENTOR(S) : Robert M. Nardone

It is certified that error appears in the above—identified patent and that said Letters Patent is hereby corrected as shown below:

Column 8, Claim 6, line 1, change "6" to --5--.

Signed and Sealed this

*Fifteenth* Day of *February 1983*

[SEAL]

*Attest:*

GERALD J. MOSSINGHOFF

*Attesting Officer*

*Commissioner of Patents and Trademarks*